US007316400B1

(12) United States Patent
Holsten et al.

(10) Patent No.: US 7,316,400 B1
(45) Date of Patent: Jan. 8, 2008

(54) WATER PUMPING GAME APPARATUS

(76) Inventors: Janet Holsten, 16 Twin Oaks Rd., Parsippany, NJ (US) 07054; William Holsten, 16 Twin Oaks Rd., Parsippany, NJ (US) 07054

( * ) Notice: Subject to any disclaimer, the term of this patent is extended or adjusted under 35 U.S.C. 154(b) by 0 days.

(21) Appl. No.: 11/599,012

(22) Filed: Nov. 13, 2006

(51) Int. Cl.
*A63F 9/00* (2006.01)

(52) U.S. Cl. ..... 273/445; 273/459; 273/440

(58) Field of Classification Search ..... 273/457, 273/445, 440, 459
See application file for complete search history.

(56) References Cited

U.S. PATENT DOCUMENTS

| | | | | |
|---|---|---|---|---|
| 4,118,027 | A * | 10/1978 | Cody | 273/457 |
| 4,305,580 | A | 12/1981 | Tourand | |
| 5,100,156 | A | 3/1992 | Mayne | |
| 5,195,751 | A * | 3/1993 | Senart | 273/349 |
| 5,439,230 | A | 8/1995 | Mendes, Jr. | |
| 5,573,243 | A | 11/1996 | Bartosik | |
| 5,865,438 | A * | 2/1999 | Zilliox | 273/349 |
| 5,954,338 | A | 9/1999 | Hampton | |
| 6,210,287 | B1 * | 4/2001 | Briggs | 472/128 |
| 6,264,201 | B1 * | 7/2001 | Holsten et al. | 273/384 |
| 6,296,252 | B1 * | 10/2001 | Hubka | 273/384 |
| 6,422,566 | B1 * | 7/2002 | Rudell et al. | 273/445 |
| 6,454,261 | B2 * | 9/2002 | Ohira | 273/140 |
| 6,694,898 | B1 | 2/2004 | Cook, II | |
| 6,733,013 | B1 * | 5/2004 | Bartels et al. | 273/349 |
| 7,134,665 | B2 * | 11/2006 | Holsten et al. | 273/458 |
| 2006/0175760 | A1 * | 8/2006 | Holsten et al. | 273/440 |

* cited by examiner

*Primary Examiner*—Raleigh W. Chiu
(74) *Attorney, Agent, or Firm*—Patel & Alumit, P.C.; Edwin Tarver; Ty Ung

(57) ABSTRACT

A game apparatus comprising at least two receptacles, at least two pumps for pumping fluid into the at least two receptacles and a weight-activated mechanism to deliver the receptacle contents to a location of the pumps after a receptacle is filled with a predetermined amount of fluid. Connections between the pumps and receptacle may be made such that a receptacle does not deliver its contents to the location of a pump filling it. However, the connections can also be made such that the receptacle delivers its contents to the location of the pump filling it.

24 Claims, 4 Drawing Sheets

WATER PUMPING GAME APPARATUS

CROSS-REFERENCE TO RELATED APPLICATION: None

FEDERALLY SPONSORED RESEARCH: Not Applicable

SEQUENCE LISTING OR PROGRAM: Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to game apparatuses, and more particularly to a water pumping game apparatus.

Several games apparatuses involving fluid pumping and manipulation have been developed in that art. For example, U.S. Pat. No. 4,305,580 to Tourand discloses a liquid propelled game that comprises a housing with a liquid-filled playing area having defined passageways which are dimensioned to receive a projectile. A first player operates a first liquid directing plunger which creates currents within the liquid-filled playing area that propel the projectile toward a first target, while a second player simultaneously manipulates a second liquid directing plunger in an attempt to cause the projectile to deviate away from the path of travel through the liquid toward the first target and towards a second target associated with the second player. A liquid reservoir, pump and conduits are provided for filling the playing area with liquid before the start of play and for evacuating the liquid from the playing area after a predetermined amount of playing time has elapsed.

U.S. Pat. No. 5,439,230 to Mendes, Jr. discloses a water columnar race game in which two or more players compete to fill a column of water by engaging a target with a fluid or solid projectile stream or a light beam. Detectors upon a target are adapted to signal a separate water pressure device in order to force water from a reservoir up into and through a transparent or translucent column. At the top of such column, a detector awaits the rising column of water in order to signal its arrival and indicate the success of the player in engaging his or her respective target. The apparatus can be configured so that each player's column is filled from a separate reservoir or from a common reservoir.

U.S. Pat. No. 5,954,338 to Hampton discloses a water column game that includes a plurality of vertically oriented water columns, each having a housing disposed at the upper end thereof coaxial with and in open communication with the column. A float is freely disposed and captured within each housing. A target and valves are responsive to a game player for directing water into a lower end of each water column, such that water rises within the column and the housing in sequence so as to raise the float buoyantly within the housing. A switch is disposed at the upper end of each housing, and is responsive to contact by the float for indicating that the float has reached the upper end of the column. The water-fill volume of each column and housing is adjustable and all columns are fed from a common pump for equalizing the opportunity of each player to win.

Although the above games involve fluid pumping, the end result of the game and associated apparatus of the present invention are different. The present invention involves fluid pumping by players, and the object of the game is to drench opponents with the pumped fluid, after pumping a predetermined amount of fluid.

SUMMARY

The present invention is a water pumping game apparatus comprising at least two pumps, at least two receptacles and a means for delivering receptacle contents to a pump location. The pumps derive water from a fluid source and pump fluid into at least one receptacle. The means empties receptacle contents only after a receptacle contains a predetermined amount of fluid. Once emptied, each receptacle is capable of delivering its contents to a pump location. Connections between the pumps and receptacle may be made such that a receptacle does not deliver its contents to the location of a pump filling it. However, the connections can also be made such that the receptacle delivers its contents to the location of the pump filling it.

A two-player embodiment of the present invention comprises two pumps and two receptacles. A first pump outflow is connected to a second receptacle, and a second pump outflow is connected to a first receptacle. The first and second receptacles deliver their contents to second and first pump locations, respectively, once they contain the predetermined fluid amount.

FIGURES

Reference Numerals

Figure 1:
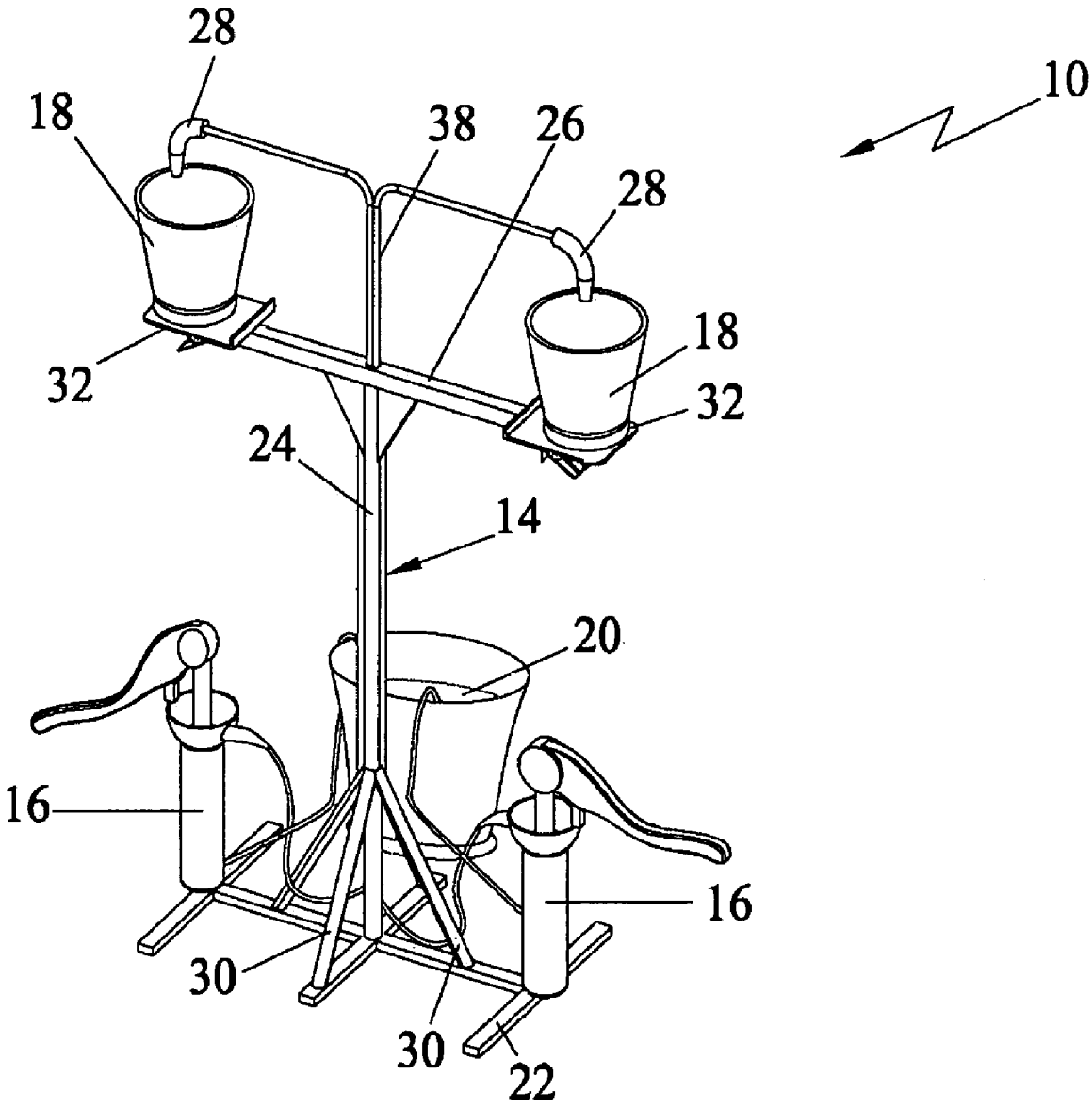
FIG. 1 is a perspective view of the water pumping game apparatus in accordance with the present invention.

10 . . . Water Pumping Game Apparatus
12 . . . Player
14 . . . Support
16 . . . Hand Pump
18 . . . Bucket
20 . . . Water Source
22 . . . Base
24 . . . Vertical Stand
26 . . . Horizontal Supporting Bar
28 . . . Spout
30 . . . Inclined Supporting Member
32 . . . Platform
34 . . . Hinge
36 . . . Torsion Spring
38 . . . Water Pipe

DETAILED DESCRIPTION

Referring to the drawings, a preferred embodiment of a water pumping game apparatus is illustrated and generally indicated as 10 in FIGS. 1 through 4. The apparatus 10, which is basically designed for two players 12, comprises a support 14, two hand pumps 16, two buckets 18, and a water source 20.

Referring to FIG. 1, the support 14 comprises a base 22, a vertical stand 24, a horizontal supporting bar 26, and two spouts 28. The vertical stand 24 is attached to the base 22 centrally and is supported by a plurality of inclined supporting members 30, which are attached to the vertical stand 24 and the base 22. The horizontal supporting bar 26 is attached on top of the vertical stand 24 centrally.

Figure 2:
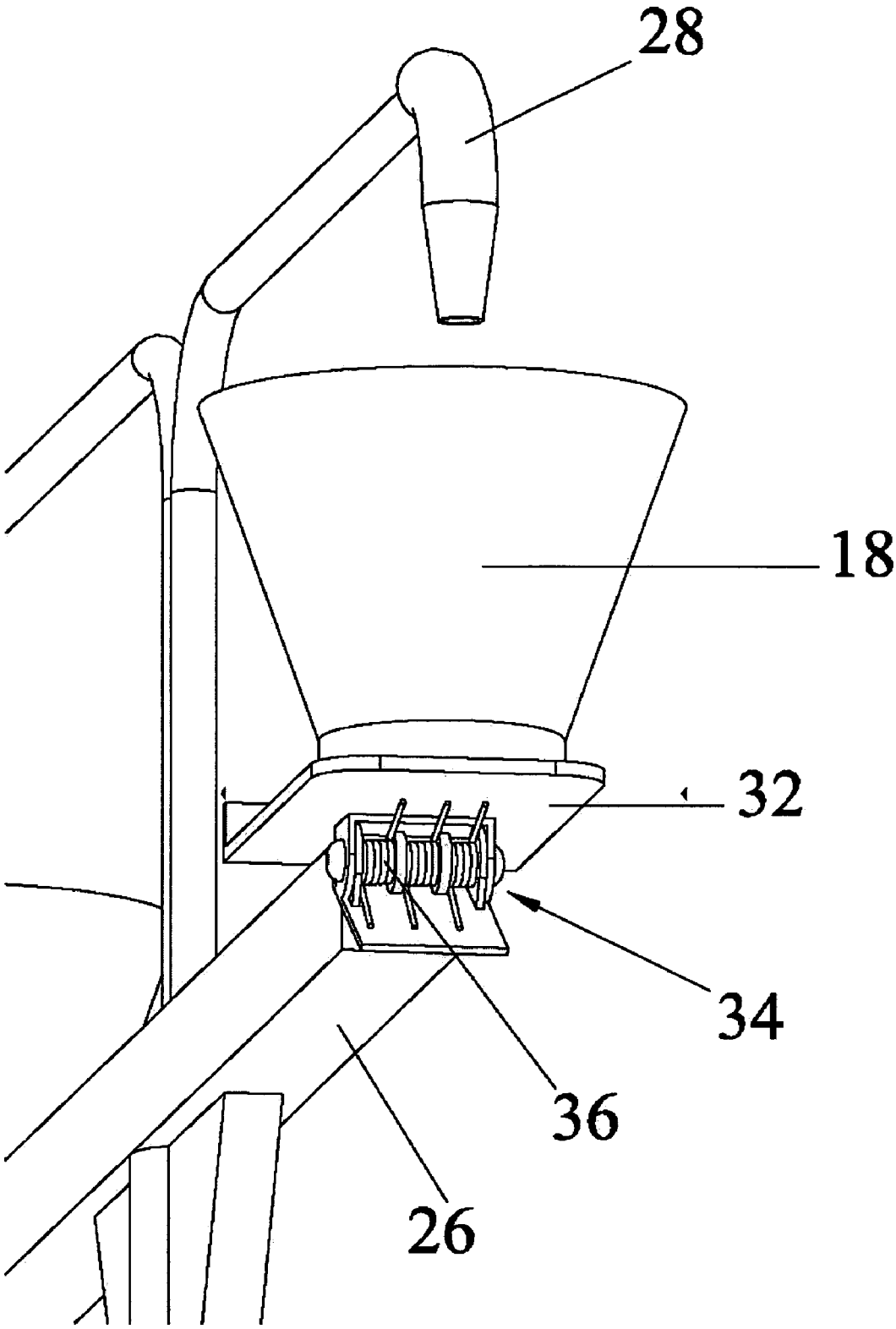
FIG. 2 is perspective view of the hinge in accordance with the present invention.

Referring to FIGS. 1 and 2, the support 14 further comprises two platforms 32, each connected to an end of the horizontal supporting bar 26 by a hinge 34, which is combined with a plurality of torsion springs 36. More particularly, the underside of the platform 32, rather than the edge, is hinged at the end of the horizontal supporting bar 26. Each bucket 18 is permanently mounted over each platform 32.

Referring to FIG. 1, the pumps 16 are mounted over the base 22 of the support 14 such that each pump 16 is located below a platform 32, and thus the pumps 16 are diametrically opposite to each other. Each pump 16 is connected to a spout 28 by a water pipe 38 and/or water hose; each spout 28 being disposed over the oppositely located bucket 18 as seen in the figure. The spout 28 may also be accomplished by a bend in the water pipe 38 rather than a separate component. The pumps 16 draw water from the water source 20, which could be a typical bucket filled with water, a water pool, or water tank.

Figure 3:
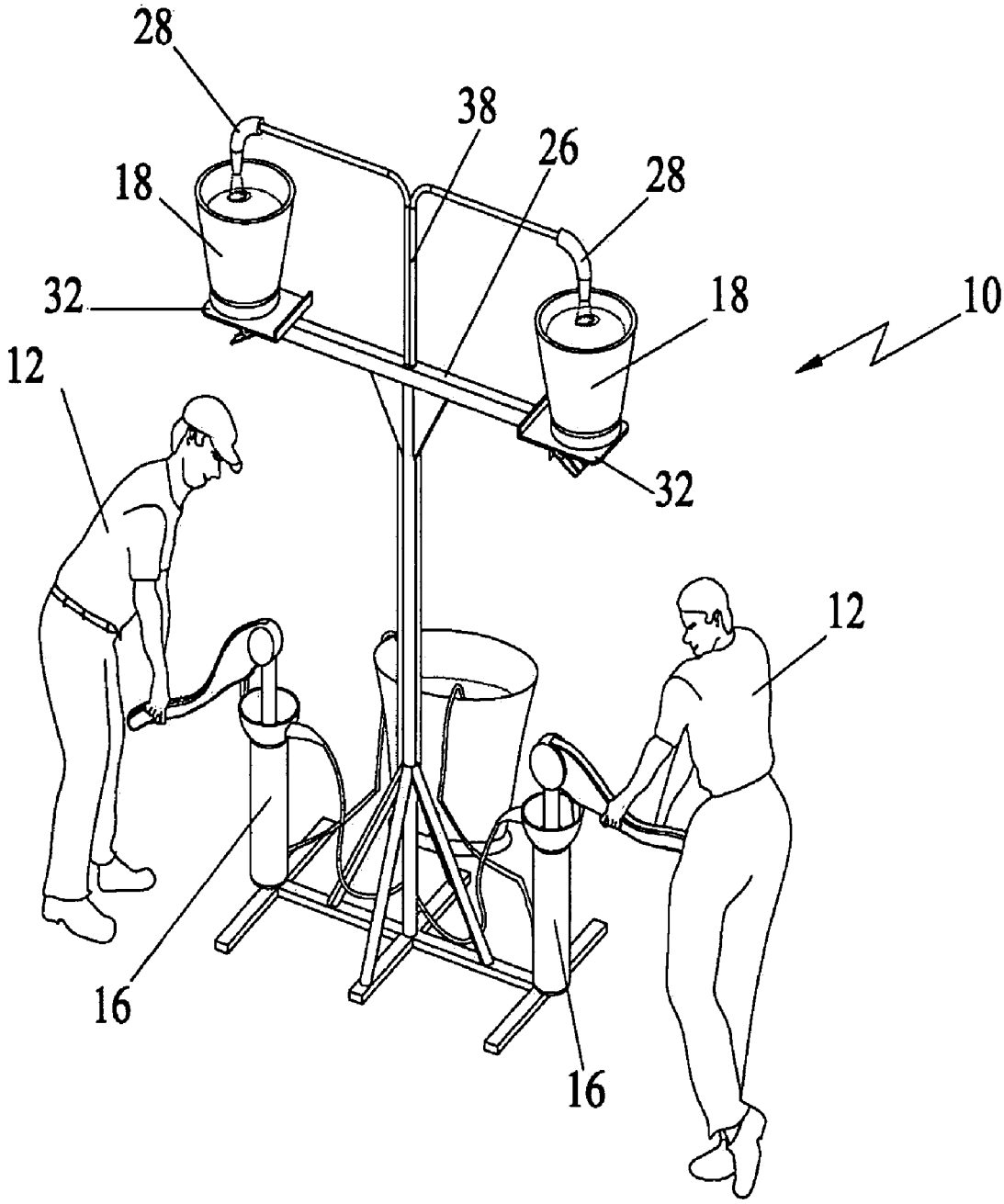
FIGS. 3 and 4 are the perspective views of the water pumping game apparatus being operated by players in accordance with the present invention.
Figure 4:
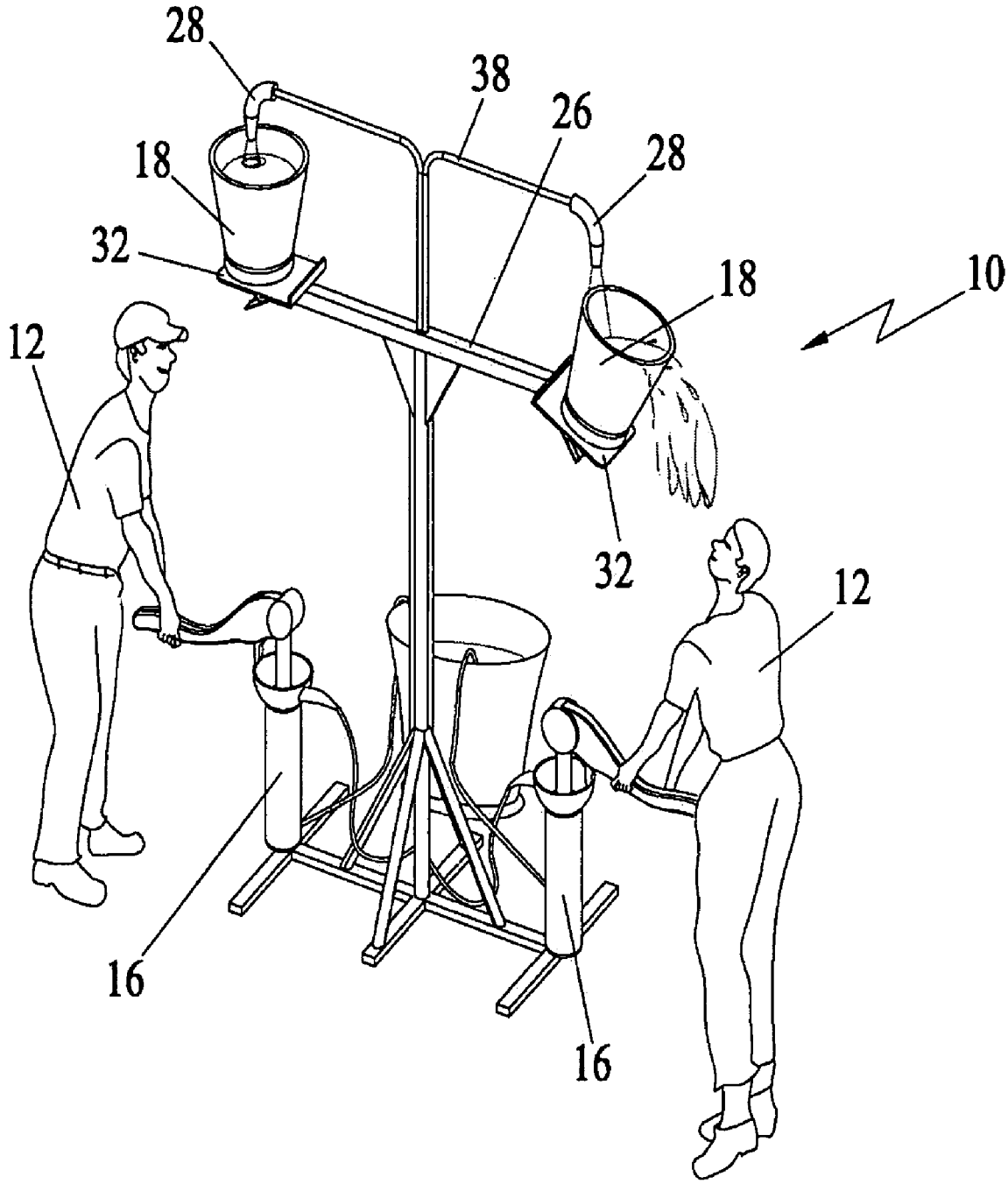

Referring to FIGS. 3 and 4, in order to play the game, each player 12 has to pump water from the water source 20 into the oppositely disposed buckets 18 simultaneously. Eventually, when the weight of a bucket 18 combined with that of the filled water exceeds the hinging strength of the platform 32, i.e., the amount of weight up to which the hinged platform 32 can support a bucket 18 in its vertical position, the platform 32 tilts about the hinge 34, thereby pouring out the water in the bucket 18 over a player 12 operating below it. Once the water is emptied in the bucket 18, the springs 36 of the hinge 34 enable the platform 32 to regain its original position. Thus, whoever succeeds in pouring out the water in the bucket 18 first over the other player 12, wins the game.

Although the game apparatus 10 is designed for two players 12, the apparatus 10 can be structurally modified so as to make it a multiple player game. Also the hand pump 16 could be a lever pump, a rotary pump, or any other mechanism for accomplishing a similar task.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A game apparatus comprising:

(a) at least two receptacles;

(b) at least two means for pumping fluid into the at least two receptacles; and (c) a means for delivering receptacle contents to a location of a pumping means once a receptacle is filled up with a predetermined amount of fluid.

2. The apparatus of claim 1, wherein each receptacle comprises a container.

3. The apparatus of claim 2, wherein each container has at least one open side, including an open top.

4. The apparatus of claim 3, wherein each container is a bucket.

5. The apparatus of claim 1, wherein each pumping means comprises a pump.

6. The apparatus of claim 5, wherein each pump is manually operated.

7. The apparatus of claim 5, wherein each pump is a manually operated lever pump.

8. The apparatus of claim 5, wherein each pump is a manually operated rotary pump.

9. The apparatus of claim 5, wherein each pump is a manually operated foot pump.

10. The apparatus of claim 1, wherein the predetermined amount refers to a predetermined level.

11. The apparatus of claim 1, wherein the predetermined amount refers to a predetermined weight.

12. The apparatus of claim 1, wherein the predetermined amount is equal for all the receptacles.

13. The apparatus of claim 1, wherein the means for delivering comprises a plurality of weight activated mechanisms, wherein each mechanism is associated with a receptacle.

14. The apparatus of claim 13, wherein each mechanism comprises a hinge, combined with a plurality of springs; the hinge supports a receptacle over a pumping means location in a vertical position.

15. The apparatus of claim 14, wherein each spring is a torsion spring.

16. The apparatus of claim 14, wherein when the fluid in a receptacle reaches the predetermined amount, the hinge allows the receptacle to tip over, thereby pouring the fluid over the location of the pumping means beneath it; the springs enable the receptacle to regain its original position once the fluid is emptied.

17. The apparatus of claim 16 wherein the hinge connects a support and a platform, upon which the receptacle is mounted, wherein the platform collapses about the hinge when the fluid in the receptacle reaches the predetermined amount.

18. The apparatus of claim 17, wherein the support comprises a vertical structure.

19. The apparatus of claim 14, wherein when the fluid in a receptacle reaches the predetermined amount, the hinge allows the receptacle to tip over, so that the fluid is delivered to the location of the pumping means through a hose.

20. The apparatus of claim 1, wherein the fluid is water.

21. The apparatus of claim 1, wherein individual or multiple receptacles can be filled by individual or multiple means for pumping, and individual or multiple receptacles can deliver contents to individual or multiple locations of the at least two means for pumping.

22. The apparatus of claim 1, wherein the at least two means for pumping derive the fluid from a single source or multiple sources.

23. The apparatus of claim 1, wherein a receptacle never delivers its contents to the location of the pumping means, which supplies its fluid.

24. A water pumping game apparatus that is to be played with two players, the apparatus comprising:

(a) a support comprising a base, a vertical stand connecting the base centrally, a horizontal supporting member disposed on top of the vertical member centrally, two platforms, each connected to an end of the horizontal supporting member by a hinge, which is combined with a plurality of torsion springs;

(b) two buckets, each bucket permanently mounted on a platform;

(c) two pumps, each placed underneath a bucket, the pumps for pumping water into the two buckets such that the water which is being pumped through a pump is delivered to a bucket which is disposed oppositely to that pump;

wherein when the water in a bucket exceeds a predetermined weight, the platform collapses about hinge thereby pouring out the water in the bucket over a player operating thereunder; the springs enable the platform along with the bucket to regain former position.

* * * * *